US006543905B1

(12) United States Patent
Adams et al.

(10) Patent No.: US 6,543,905 B1
(45) Date of Patent: Apr. 8, 2003

(54) REFLECTIVE DECORATIVE LIGHT HOLDER

(75) Inventors: William E. Adams, Portersville, PA (US); Matthew H. French, Slippery Rock, PA (US)

(73) Assignee: Adams Mfg. Corp., Portersville, PA (US)

( * ) Notice: Subject to any disclaimer, the term of this patent is extended or adjusted under 35 U.S.C. 154(b) by 0 days.

(21) Appl. No.: 10/004,359

(22) Filed: Oct. 31, 2001

(51) Int. Cl.[7] ..... F21S 6/00
(52) U.S. Cl. ..... 362/122; 362/806; 362/808
(58) Field of Search ..... 362/122, 121, 362/123, 249, 327, 329, 330, 332, 339, 307, 308, 346, 431, 806, 331, 297, 808

(56) References Cited

U.S. PATENT DOCUMENTS

| | | | | |
|---|---|---|---|---|
| 301,083 A | | 7/1884 | Bornstein | |
| 1,123,969 A | | 1/1915 | Wiley | |
| 1,625,303 A | | 4/1927 | Fenton | |
| 1,981,663 A | * | 11/1934 | Pollock | 362/121 |
| 2,067,701 A | | 1/1937 | James | |
| 2,167,149 A | | 7/1939 | Grote | |
| 2,191,041 A | * | 1/1940 | Protz | 362/121 |
| 2,330,194 A | | 9/1943 | Blau | |
| 2,465,700 A | | 3/1949 | Tuttle | |
| 2,486,636 A | | 11/1949 | Egle | |
| 2,578,182 A | | 12/1951 | Fricano | |
| 2,892,074 A | * | 6/1959 | O'Marrow | 362/122 |
| 3,671,101 A | | 6/1972 | Finch | |
| 5,050,327 A | | 9/1991 | Woltman | |
| D331,360 S | | 12/1992 | Adams | |
| 5,241,462 A | * | 8/1993 | Sugimato | 362/339 |
| 5,303,492 A | | 4/1994 | Nishio | |
| 5,667,174 A | | 9/1997 | Adams | |
| D406,788 S | | 3/1999 | Adams et al. | |
| 6,027,228 A | | 2/2000 | Adams | |

FOREIGN PATENT DOCUMENTS

| | | |
|---|---|---|
| FR | 674830 | 2/1930 |
| FR | 799964 | 6/1936 |

* cited by examiner

*Primary Examiner*—Y. My Quach-Lee
(74) *Attorney, Agent, or Firm*—Buchanan Ingersoll, P.C.

(57) ABSTRACT

A decorative light holder has a decorative shape, is made of a translucent material and has at least three substantially parallel reflective surfaces. A portion of light striking each surface is reflected and another portion of that light passes through the light holder. This structure provides a pleasing appearance in which areas of one side of the light holder appear to be darker than other areas of the same side. The corresponding areas on the opposite side of the light holder also appear to be lighter and darker but the area that was lighter on one side is darker on the opposite side and the area that was darker on one side is lighter on the opposite side. When made of two injection molded pieces, each piece is made of a different color plastic, enhancing the pleasing appearance of the holder. Preferably the surfaces on at least one side are textured, such as with a prismatic structure.

14 Claims, 9 Drawing Sheets

REFLECTIVE DECORATIVE LIGHT HOLDER

FIELD OF THE INVENTION

The present invention relates to a holder for decorative electrical lights that can be used in conjunction with stakes fixed to the ground, or supports fixed to a wall or vertical surface such as nails, screws, or suction cups.

BACKGROUND OF THE INVENTION

Strings of electrical lights for decorating a house, shrubbery, or other structures, particularly at various holidays throughout the year, are well known in the art. Strings of electrical lights are typically attached to a house or other structure by various means that have several drawbacks. Affixing strings of light by stapling the wire between sockets holding light bulbs onto a surface results in damage created by staples on the surface of the structure. The staples can also cause damage to the insulation around the electrical wire and thus cause electrical malfunction or even create a fire or electrocution hazards. These are also the drawbacks of attaching the strings of electrical lights to a house with nails or screws.

There are provided in the prior art various devices for holding the sockets of strings of electrical lights. Typically these devices have a holding portion for gripping a decorative light socket and a hook, clip or other structure for mounting the holder on a structure or surface. Decorative light strings are available in three sizes C9, C7, and mini. In some prior art devices the holding portion will hold only one of the three sizes. Other holders such as the device disclosed in U.S. Pat. No. 5,667,174, can hold all three sizes.

There are many other devices for attaching strings of electrical lights onto a house or other surfaces that hold the cord. A device for attaching Christmas lights adjacent roofing shingles is also disclosed in U.S. Pat. No. Des. 331,360. This device has a small stake which fits between the shingles and a single spiral at one end. The spiral end is sized to hold the wire of the Christmas light string, not a bulb or socket.

Similar devices comprised of a stake or straight pin with a curved holder attached at one end have been used to retain other structures or products. Mahin in U.S. Pat. No. 441,429 discloses such a structure for use as a hanger for mounting gutters. Borstein in U.S. Pat. No. 301,083 and Fenton in U.S. Pat. No. 1,625,303 disclose pins for holding price cards or securing upholstered parts of automobiles. A skewer having this basic shape is taught by Fricano in U.S. Pat. No. 2,578,182. None of these devices are suitable for holding decorative light strings.

Most of the devices found in the prior art are strictly functional and grip the light bulb sockets not the electrical cord between bulbs. Egle in U.S. Pat. No. 2,486,636 describes a plastic decorative light bulb socket with smooth reflective surfaces in the shape of a star. Tuttle in U.S. Pat. No. 2,465,700 describes an ornamental fixture decorative light having interchangeable decorative shapes mountable over a light bulb socket. The Tuttle decorative light socket can be slidably attached to an electrical connection which in turn can be mounted on a Christmas tree by a clip.

U.S. Pat. No. Des. 406,788 discloses a decorative light holder that is in the shape of a reindeer. However, this disclosure differs from the present invention in several important respects. Most notably the means for holding the decorative light strings in the '788 patent is a clip that receives for attaching the socket of a decorative light. Another important difference is that the holding position of the electrical light string is on only one side of each decorative light holder, so that the clip holds the socket adjacent to one surface of the decorative light holder, which limits the versatility of an individual holder.

There is also disclosed in U.S. Pat. No. 1,123,969 issued to R. W. Wiley an illuminated sign having multiple reflective surfaces and lens-like surfaces to enhance the scattering of light, thus increasing the luminescence of the sign in the form of letters or numbers. The disclosure refers to the reflective surfaces as prismatic surfaces which may be of regular or irregular shapes but form several different reflective planes for scattering light. One important feature of this sign is that the reflective surfaces work in combination with lens-like surfaces in one direction only as they are primarily directed to work with artificial lighting from behind the signs.

Other products having reflective surfaces are disclosed in U.S. Pat. Nos. 2,067,701, 2,167,149, and 2,330,194 issued to C. A. James, W. F. Grote, and H. H. Blau respectively. The James reference discloses a pressed glass reflecting device for use in roadway signs. The reflection of light is effected by a pressed glass whose front surface is cylindrical while its back surface is composed of a plurality of curved right angle grooves. The front surface focuses incident light in a line along the grooves. The light then is reflected back through the front surface toward the light source. Thus, reflection of light is effected in a single direction. The Grote reference discloses a reflecting prism sheet composed of a colored or colorless transparent resin sheet having a plurality of "cube corners" or prisms providing light reflective surfaces and a back portion which may be of a light reflecting material like a colored foil. Light comes through the front of the device and is reflected by the prisms and the back of the device back through the front in substantially the same plane as the entering light. The Blau reference discloses a reflecting optical system for reflecting signals that can be produced at a reduced cost. The device can reflect light in more than one plane by having reflective surfaces that reflect all the light passing through a light transmissive portion back through the origin of the light source. Because of the configuration of this device, the light transmissive and reflecting areas are mutually exclusive so that the appearance of the two planes of reflected light are limited to that of reflective surfaces on each plane.

U.S. Pat. No. 3,671,101 issued to D. M. Finch discloses a light control surface having a light transmitting component and a light reflective component having a plurality of geometric surfaces, preferably hexagonal pyramids. The geometric reflective surfaces can also be right regular rectangular or triangular pyramids or right regular cones. However, this light control surface reflects light in only one direction.

Road signs having retroreflective properties in only one direction are disclosed in U.S. Pat. No. 5,050,327 issued to Woltman in 1991, and U.S. Pat. No. 5,303,492 issued to D. Nishio in 1994. The Woltman patent discloses a road sign incorporating a retroreflective translucent layer and a light retroreflective layer configured such that light is primarily retroreflected in one direction only. The Nishio patent discloses a road sign having reflective surfaces reflecting light to a viewer also on only one side of the sign under direct or back lighting conditions, as in a motorway or highway. The retroreflective sheets disclosed have a characteristic pyramidal shape effecting the reflection and scattering of light to a viewer. Again, the Nishio reference discloses reflective surfaces on only one side so that light is reflected or scattered in only one primary direction, to a driver on a road. The disclosure of the Nishio patent is for a purely functional device having no decorative functions.

Thus, there is a need for a versatile decorative reflective light holder that allows for flexible spacing of the holders along a string of decorative electrical lights without the constraint of the socket positioning and which also provides a decorative function when the lights are not in use by providing a decorative shape incorporating a variety of reflective surfaces. In addition, the decorative reflective holder should be capable of being attached to a variety of surfaces through the use of stakes on the ground, a nail or screw, or a suction cup.

SUMMARY OF THE INVENTION

A decorative light holder has a decorative shape, is made of a translucent material and has at least three substantially parallel reflective surfaces. A portion of light striking each surface is reflected and another portion of that light passes through the light holder. This structure provides a pleasing appearance in which areas of one side of the light holder appear to be darker than other areas of the same side. The corresponding areas on the opposite side of the light holder also appear to be lighter and darker but the area that was lighter on one side is darker on the opposite side and the area that was darker on one side is lighter on the opposite side. Preferably the surfaces on at least one side are textured, such as with a prismatic structure.

The decorative light holder has a support on one side that is sized to receive a cord of a string of decorative lights. Consequently, the light bulbs on the string normally hang below the light holder. It is possible to support the cord immediately adjacent a light socket on the string to position the light bulb behind or adjacent a surface of the light holder.

The decorative light holder preferably has a socket that enables the light holder to be mounted on a stake. I further prefer to provide a slotted ring spaced apart from the socket that grips the stake to which the reflective decorative light holder is attached. A key hole opening for inserting the head of a nail or screw or the stem of a suction cup could also be provided in place of or in addition to the stake mounting.

The decorative light holder can be molded as either one piece or multiple pieces of an injection moldable plastic. When made of multiple pieces one piece can be snap fitted onto the other piece. Each piece may be of a different color to add to the decorative effect. The overall effect is to cause portion of light striking a surface to be reflected while another portion passes through the holder giving the decorative light holder a unique, pleasing appearance.

Additional details, objects and advantages of the invention will become more readily apparent as the following description of certain present preferred embodiments thereof proceed.

BRIEF DESCRIPTION OF THE DRAWINGS

The accompanying drawings show presently preferred embodiments of the reflective decorative light holder in which.

DETAILED DESCRIPTION OF A PREFERRED EMBODIMENT

Figure 1:
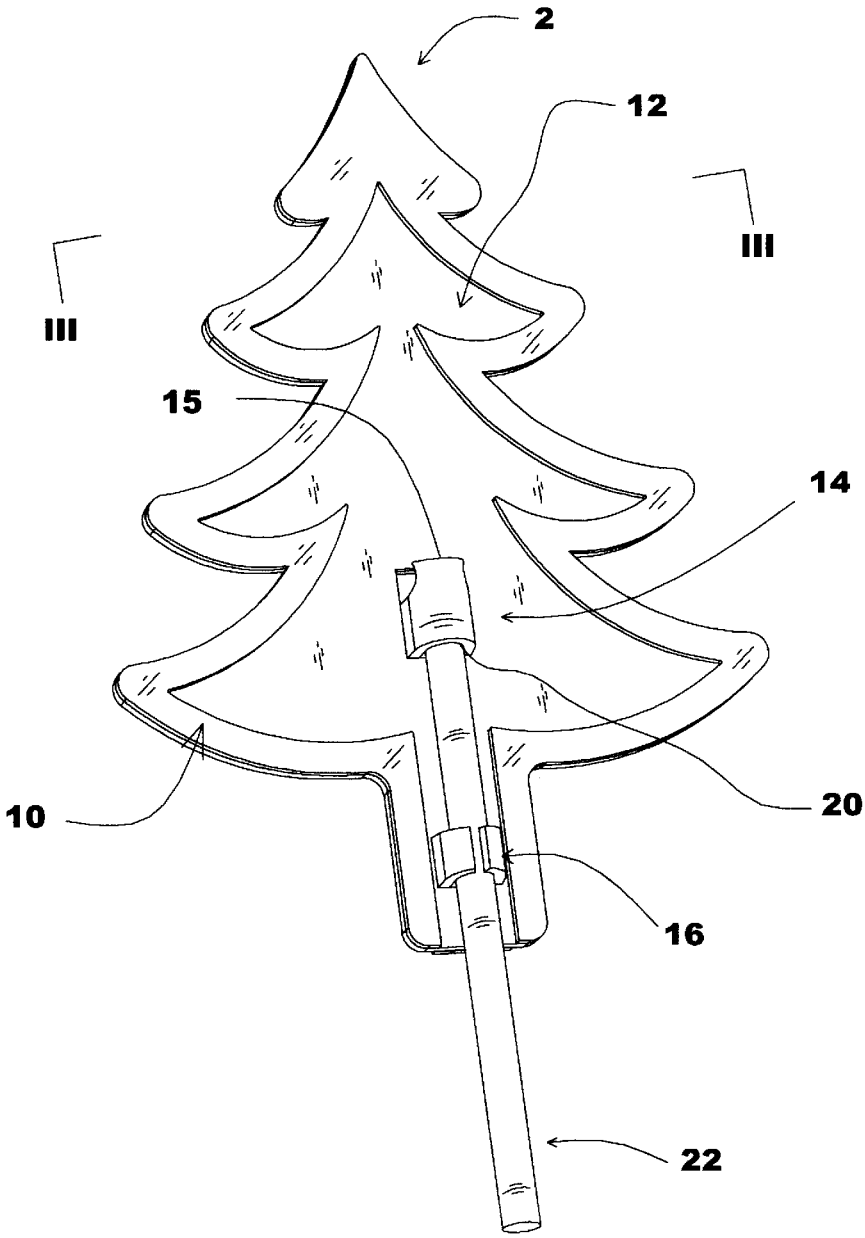
FIG. 1 is a perspective view of a first present preferred embodiment of the reflective decorative light holder in the shape of a Christmas tree.
Figure 2:
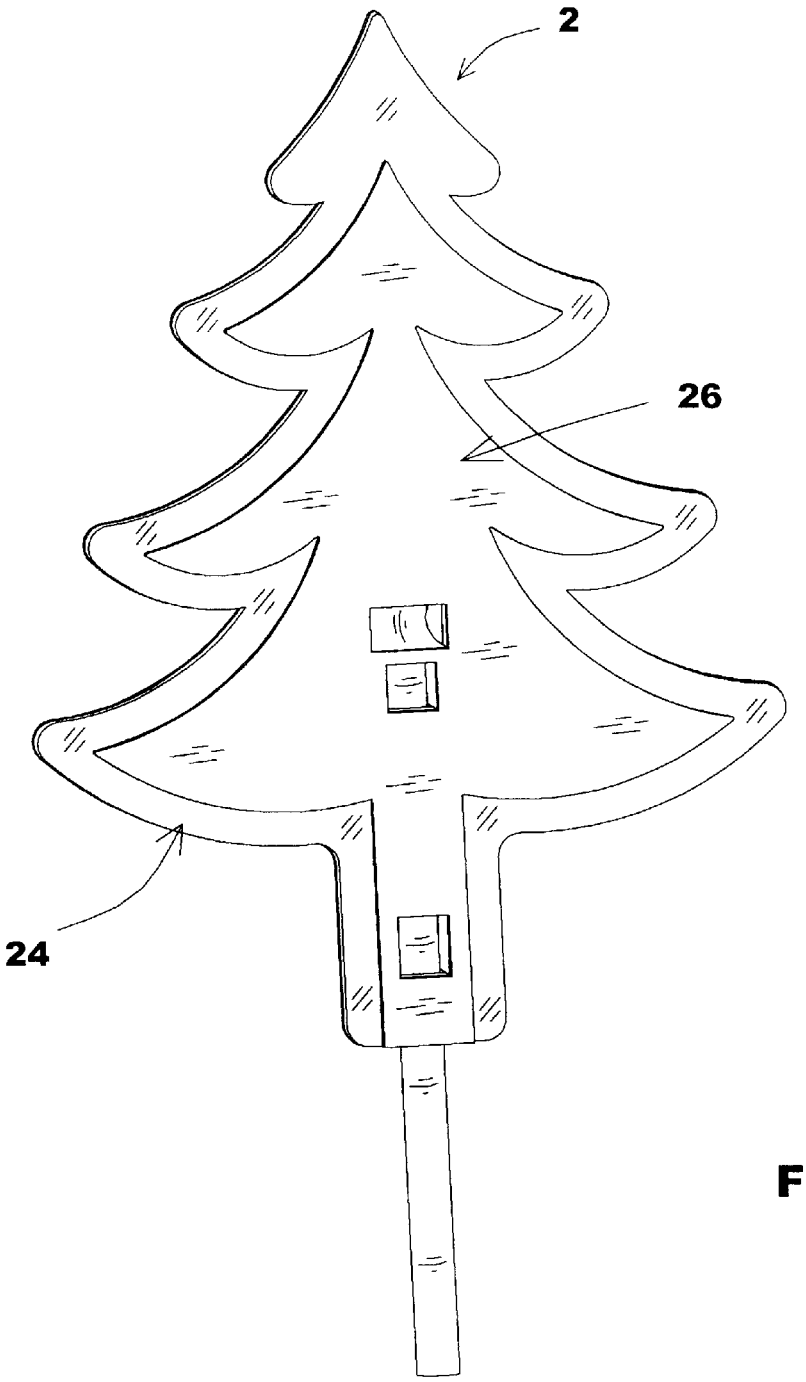
FIG. 2 is a plan view of the opposite side of the embodiment shown in FIG. 1.
Figure 3:
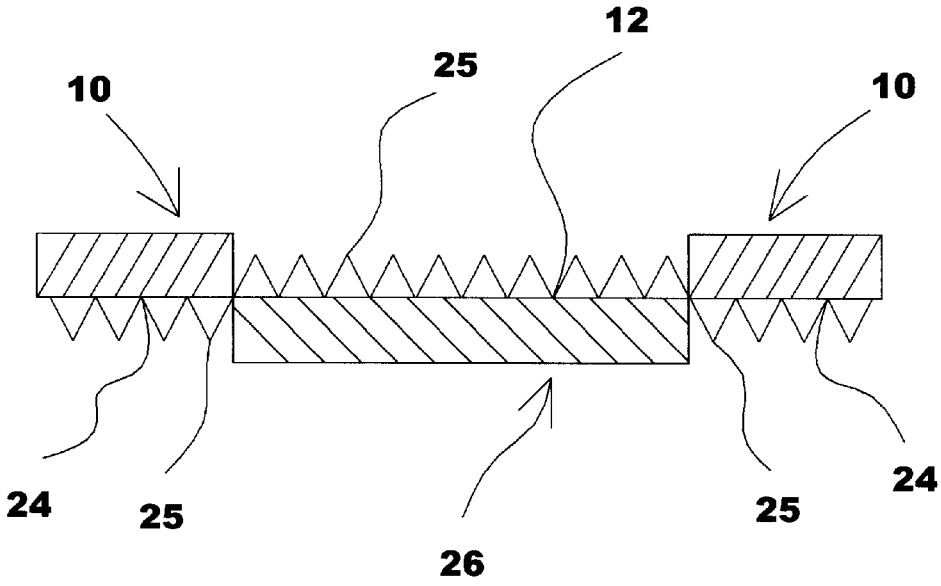
FIG. 3 is a sectional view taken along the line III—III of FIG. 1.

Referring to FIGS. 1, 2, 3, and 4 a first present preferred embodiment of the reflective decorative light holder 2 is embodied in a decorative pine tree or Christmas tree design. The reflective pine tree light holder 2 has a first reflective surface 10 and a second reflective surface 12. Surfaces 24 and 26 are opposite surfaces 10 and 12. Surfaces 12 and 24 have a prismatic structures 25. Preferably, the prismatic structures are pyramids or truncated pyramids. They could be saw teeth, hemispheres or other patterned or irregular shapes. The first and second reflective surfaces 10 and 12 are substantially parallel but not coplanar. Surfaces 24 and 26 are also substantially parallel to surfaces 10 and 12. Surfaces 12 and 24 may be coplanar. If surfaces 12 and 24 are coplanar, the reflective surfaces will be in three parallel planes. If reflective surfaces 10, 12, 24 and 26 are not coplanar, the reflective surfaces will be in four parallel planes. The reflective light holder 2 is made of a light transmissive material. Consequently, a portion of light striking any of surfaces 10, 12, 24 and 26 will be reflected and another portion will pass through the light holder. Because the surfaces 10, 12, 24 and 26 are parallel they will be different distances away from any light source. Consequently, a viewer looking at two surfaces in different planes of a light holder made from all one color of tinted plastic or glass will perceive the surface closer to him as darker than the surfaces further from him. This is true whether or not the surfaces contain prismatic structures. There is provided on either the first reflective surface 10 or second reflective surface 12 a support 14 having a hook-like projection 15 for supporting the electrical wire from a decorative light string. The support 14 and hook-like projection 15 could be any shape and configuration that securely holds a cord from a string of decorative lights. In this embodiment, the support 14 has a receiving opening or socket 20 in the support 14 opposite the hook-like projection. Preferably, the opening 20 is tapered so that the end of a stake encounters progressively smaller diameters as the stake is inserted into the opening. There is also provided on the surface 12 a slotted ring 16. A stake 22. fits through slotted ring 16 into opening 20 to support the decorative reflective holder 2. This combination of a slotted ring 16 and opening 20 securely attaches the light holder to the stake 22. We prefer that the region of surface 12 below stake 22 to be smooth even if the remainder of surface 12 is textured. The stake preferably is a fiberglass rod. The diameter of such rods may vary a few thousandths of an inch from lot to lot. The slotted ring 16 and tapered socket 20 enable the holder to accept such variances.

Figure 4:
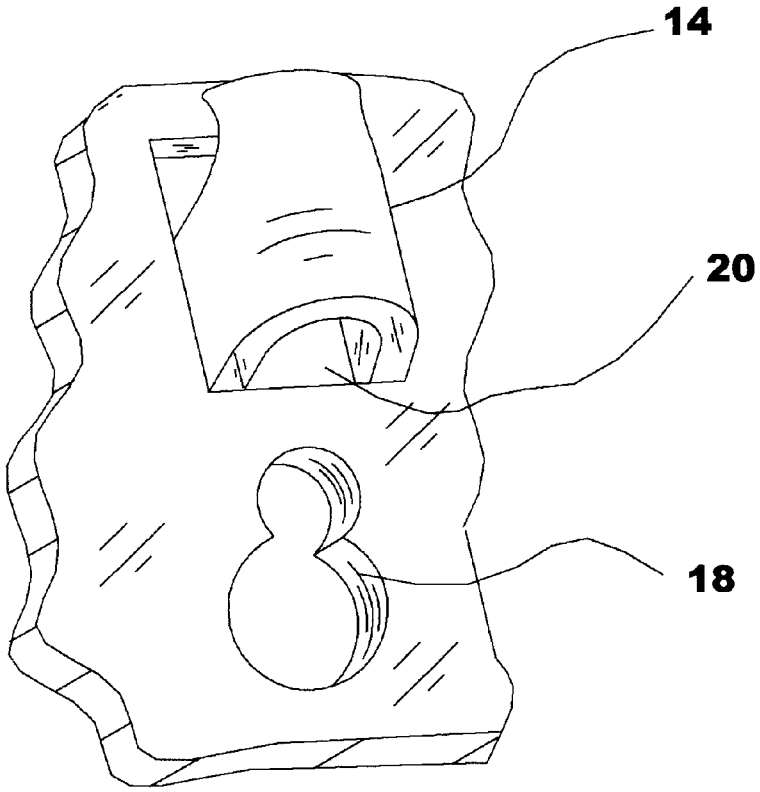
FIG. 4 is a fragmentary view of a mounting portion of a second presently preferred embodiment showing a keyhole cut into the reflective decorative light holder.

The decorative light holder could be held on a nail, screw or suction cup rather than a stake. Such an alternate embodiment for the decorative light holder would have a circular hole or a keyhole holding member 18 below the support 14 instead of or in addition to the slotted ring 16. A portion of that alternate embodiment is shown in FIG. 4. If a circular hole is provided, the head of a suction cup could be pressed fit into the hole.

A preferred embodiment of the Christmas tree, holder 2 is made of one color plastic, for instance green. Alternatively, the tree holder could be made so that the plastic forming surfaces 12 and 26 is one color while the plastic defining surfaces 10 and 24 is made of a second color. For instance, the appearance of the reflective decorative light holder could be that of a green Christmas tree with a red outline.

Figure 5:
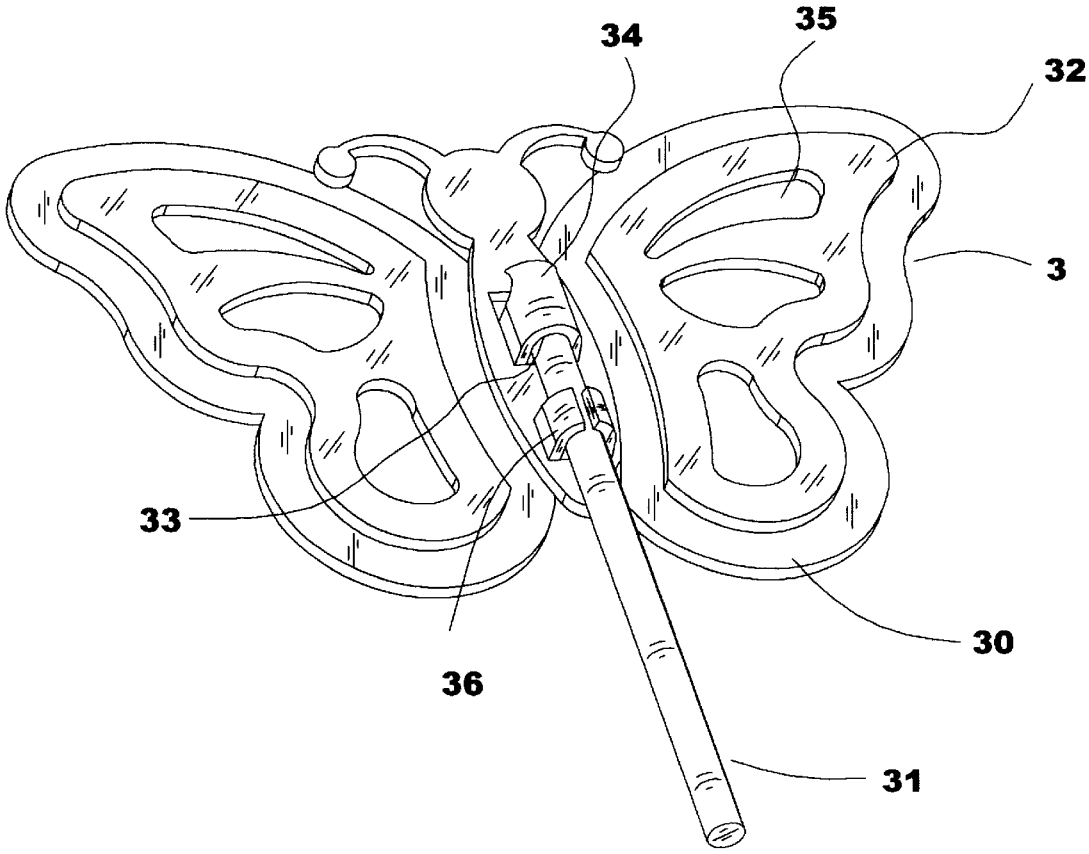
FIG. 5 is a perspective view of another presently preferred embodiment of the reflective decorative light holder in the shape of a butterfly.

Another preferred embodiment of the reflective decorative light holder 3 is embodied in a decorative design in the shape of a butterfly as depicted in FIG. 5. This light holder has a first reflective surface 30 and a second reflective surface 32 facing one direction. There are two other reflective surfaces on the opposite side of the light holder. The first and second reflective surfaces 30 and 32 as well as at least one of the surfaces on the opposite side of the holder are substantially parallel but not coplanar. Surface 30 and the surface opposite surface 32 may be substantially parallel or may be coplanar. Prismatic surfaces may be provided on any of the surfaces. At least three reflective surfaces are in three parallel planes. Reflective decorative light holder 3 would be similar to the cross-section of the first embodiment shown in FIG. 3. The light holder also has a support 34 with opening 33 and split ring 36 to receive a stake 31. Openings 35 are provided through the wings of the butterfly light holder 3.

Figure 6:
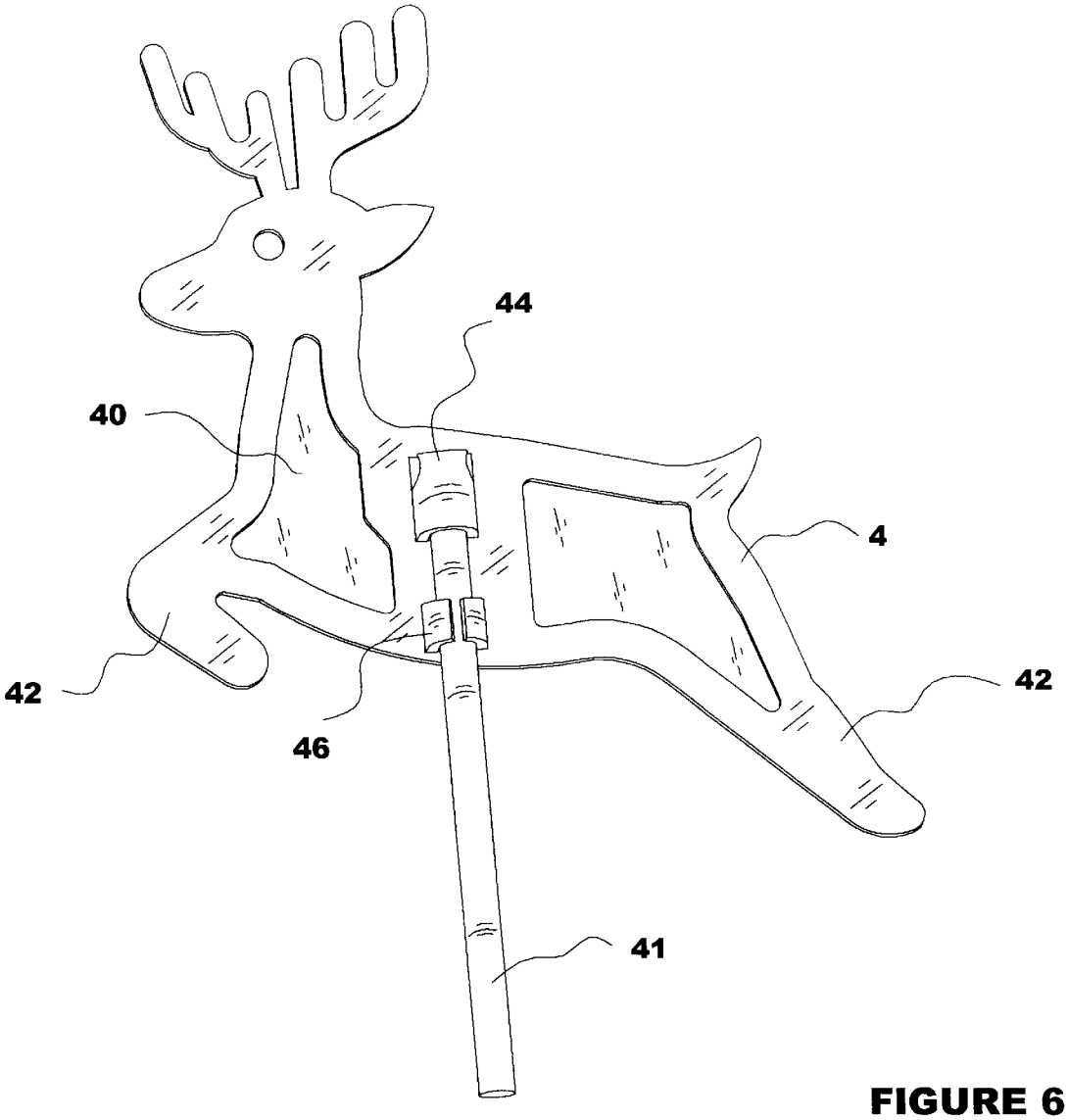
FIG. 6 is a perspective view of another presently preferred embodiment of the reflective decorative light holder in the shape of a reindeer.

Another presently preferred embodiment of the reflective decorative light holder is embodied in a decorative design having a reindeer shape 4 as depicted in FIG. 6. This embodiment incorporates a first reflective surface 40 having prismatic structures and a second reflective surface 42 that is smooth. On the opposite side of the light holder are two surfaces, one corresponding to surface 40 and the second corresponding to surface 42. Three of these four surfaces are in different parallel planes. The preferred embodiment of the reindeer also has a support 44 and a slotted ring member 46 to receive a stake 41. Like the first embodiment, the reindeer 2 may have a keyhole and may be made of one color plastic, for instance green, or two colors, for instance green and red, so that the appearance of the reflective decorative light holder is that of a green reindeer with a red outline.

Figure 7:
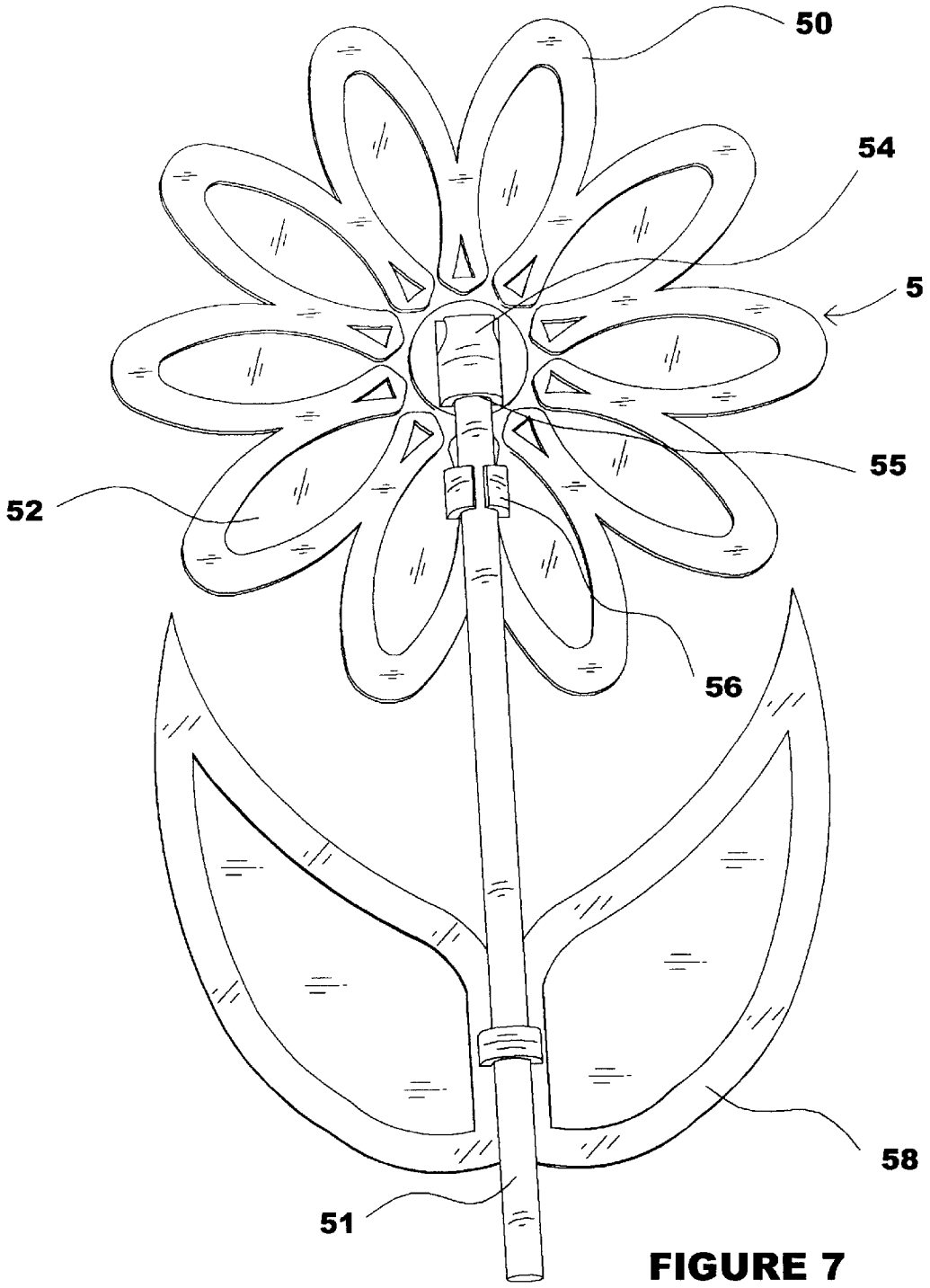
FIG. 7 is a perspective view of another presently preferred embodiment of the reflective decorative light holder in the shape of a flower.

Another presently preferred embodiment of the reflective decorative light holder 5 is embodied in a decorative design having a flower shape as depicted in FIG. 7. The flower design having a having a first reflective surface 50 that is smooth. That surface surrounds a series of second reflective surfaces 52 having prismatic structures. The first and second reflective surfaces 50 and 52 are substantially parallel but not coplanar and are parallel with at least one surface on the opposite side of flower 5. A support 54 has a hook to receive the electrical wire from a decorative light string and a recess 55 to receive a stake 51. A slotted ring holding member 56 also receives the stake 51 to support the decorative flower reflective holder. We prefer to provide reflective leaves 58 that fit onto stake 51. The flower design may also incorporate a keyhole holding member as described previously instead of or in addition to slotted ring 56. The flower design may also incorporate the first and second reflective surfaces made of different color plastic to enhance the decorative effect as previously described.

Figure 8:
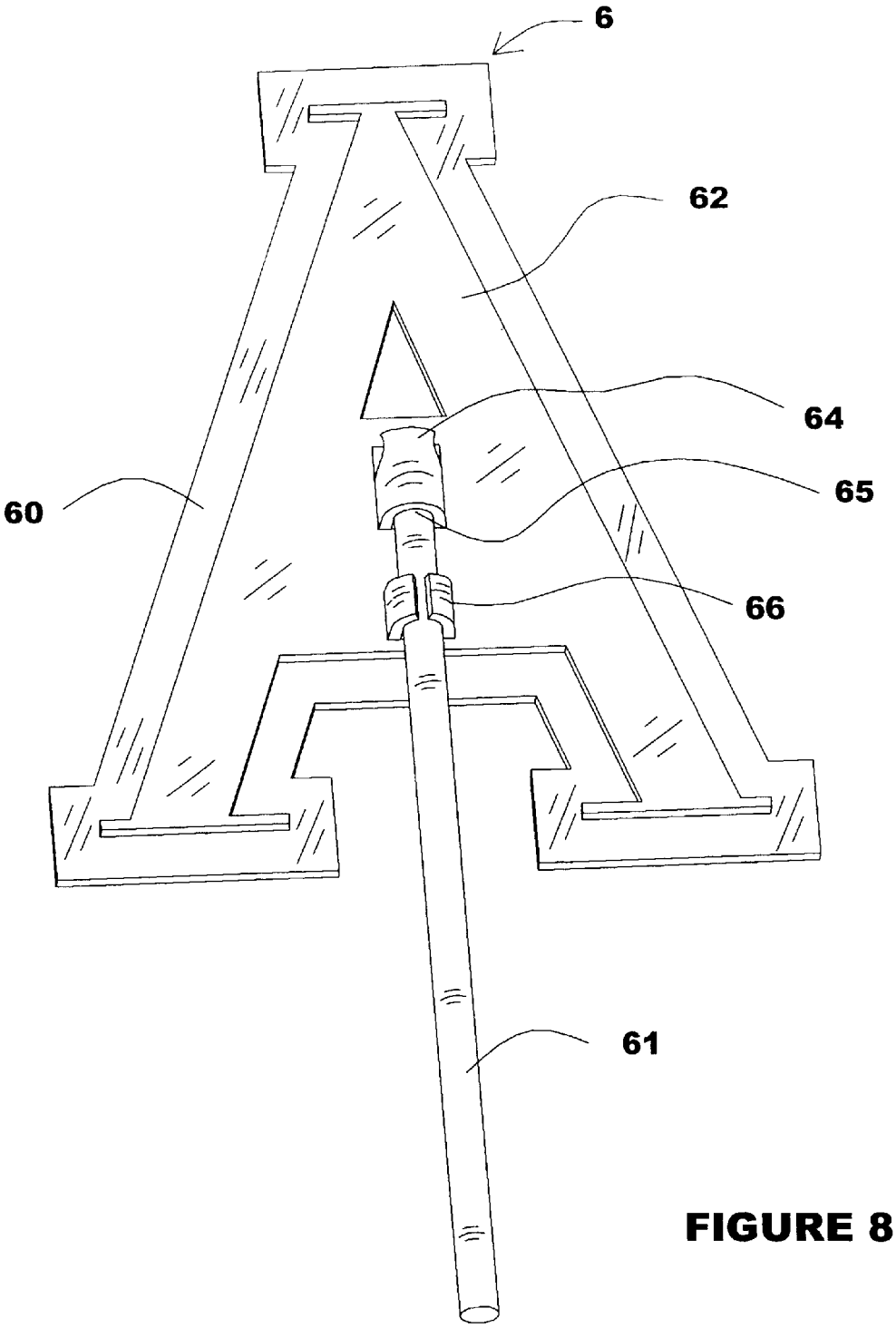
FIG. 8 is a perspective view of another present preferred embodiment of the reflective holder in the shape of the letter A.

The decorative light holder could be an alphanumeric character. Yet another embodiment of the decorative light reflector is the character "A", as depicted in FIG. 8. The "A" design 6 has a first reflective surface 60 with prismatic structures and a second reflective surface 62 having no prismatic structures. The first and second reflective surfaces are substantially parallel but not coplanar, and are parallel with at least one surface on the opposite side of the holder. At least three planes are defined by the reflective surfaces. There is also a support 64 for supporting the electrical wire from a decorative light string. A recess 65 in the support 64 and a slotted ring 66 receive a stake 61 to support the holder.

Figure 9:
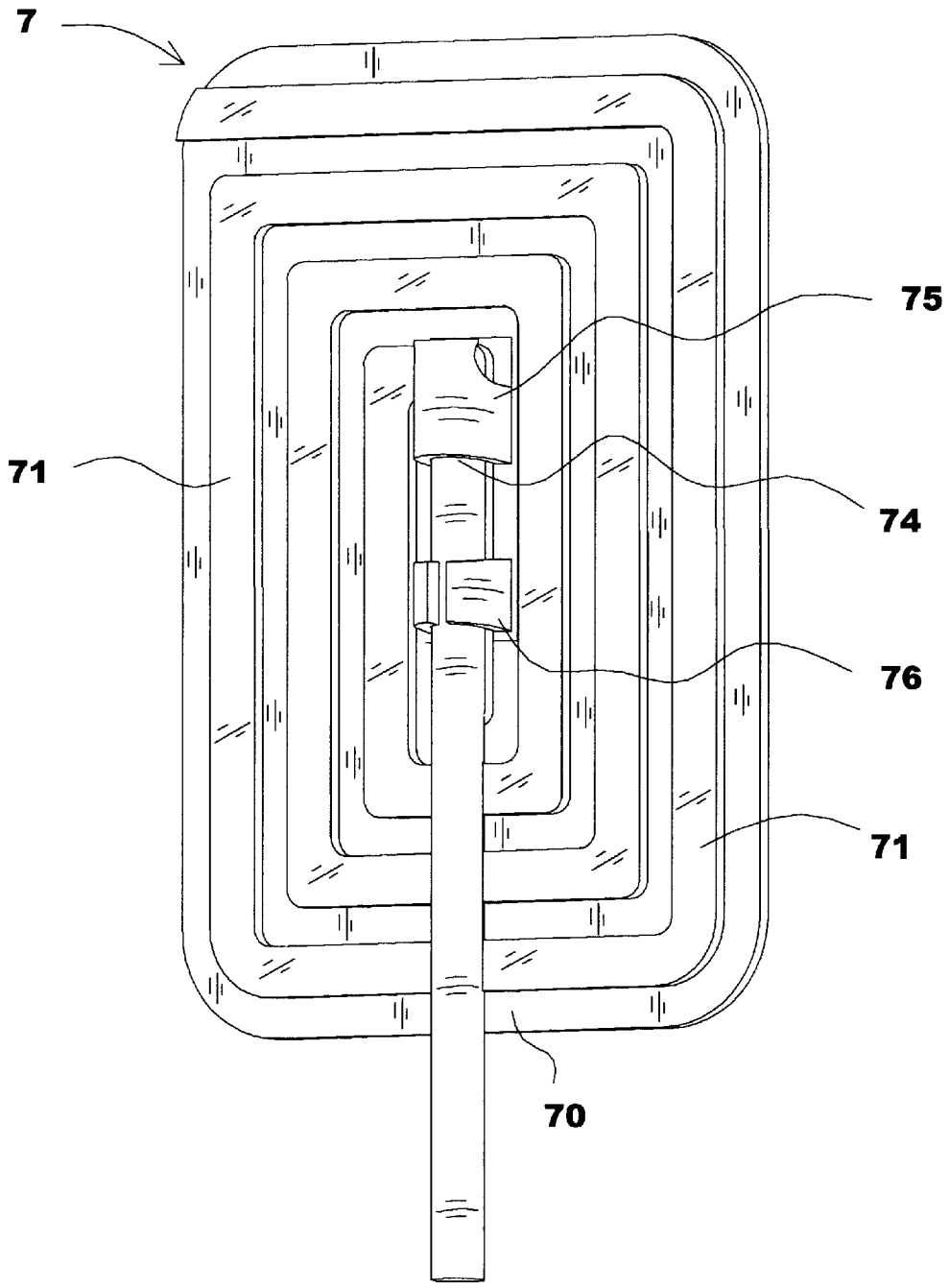
FIG. 9 is a perspective view of another present preferred embodiment of the reflective decorative light holder in a rectangular shape.

A rectangular decorative light holder 7 is shown in FIG. 9. This embodiment has a first reflective surface 70 and a series of second reflective surfaces 71 arranged in a geometric pattern parallel to the first reflective surface 70. The opposite side of the reflector 7 has a similar pattern, but the underside of surfaces 71 are closer to the center of the holder than the underside of surface 70. Consequently, on the face shown in FIG. 9 the pattern formed by surfaces 71 is raised while on the underside the pattern would be recessed. As in the previous embodiments there are at least three surfaces in parallel planes and any of the surfaces could be textured. This embodiment also has a split ring 76 and socket 74 to receive a stake and a hook 75 to hold a string of decorative lights.

It should be apparent from the preferred embodiment that the light holder could be an infinite number of shapes and sizes. It could be all one color or multicolored.

Because the light holder receives the cord rather than the socket of a decorative light string several light holders can be positioned at any desired spacing from one another. Light bulbs hanging below the light holder will provide the same light and dark regions on the light holder as back or front illumination.

Although certain presently preferred embodiments of our reflective light holder have been illustrated and described, it should be distinctly understood that the present invention is not limited thereto, but may be variously embodied within the scope of the following claims.

We claim:

1. A reflective holder for decorative lights, comprising:

(a) a body-having a decorative shape made of a translucent and light reflective material, the body having at least three reflective surfaces substantially parallel to one another so that light striking the body from a single light source is reflected on at least two planes, (b) a support on the body sized to hold a cord from a string of decorative lights in a position where at least one decorative light hangs below the body, and (c) a holding member on the body for securing the body onto a support.

2. The reflective holder of claim 1 wherein the decorative shape is selected from the group consisting of a pine tree, a reindeer, a butterfly, a flower, and alphanumeric characters.

3. The reflective holder of claim 1 wherein the holding member is a slotted ring sized to receive a stake and wherein the support on the body has a socket spaced apart from and aligned with the slotted ring, the socket sized to receive an end of the stake.

4. The reflective holder of claim 3 wherein the socket is tapered.

5. The reflective holder of claim 1 wherein the holding member is a circular hole or keyhole sized to receive a head of a suction cup, nail, or screw.

6. The reflective holder of claim 1 also comprising prismatic structures on at least one of the reflective surfaces that reflect light in multiple directions.

7. The reflective holder of claim 6 wherein the translucent and light reflective material is tinted plastic.

8. The reflective holder of claim 7 wherein the tinted plastic is multicolored.

9. The reflective holder of claim 1 wherein the body has four reflective surfaces, each surface in one of four spaced apart, parallel planes.

10. A reflective holder for decorative lights, comprising:

(a) a flower-shaped body made of a translucent and light reflective material, the body having at least three reflective surfaces substantially parallel to one another so that light striking the flower-shaped body from a single light source is reflected on at least two planes, (b) a support on the flower-shaped body sized to hold a cord from a string of decorative lights in a position where at least one decorative light hangs below the body, (c) a stake having one end attached to the flower-shaped body; and (d) at least one leaf-shaped body made of a translucent and light reflective material attached to the stake.

11. The reflective holder of claim 10 also comprising prismatic structures on at least one of the reflective surfaces that reflect light in multiple directions.

12. The reflective holder of claim 10 wherein the support contains a socket and the body further comprising a slotted ring spaced apart from and aligned with the socket such that an end of the stake passes through the slotted ring and into the socket.

13. The reflective holder of claim 12 wherein the socket is tapered.

14. The reflective holder of claim 10 wherein the flower-shaped body has four reflective surfaces each surface in one of four spaced apart parallel planes.

* * * * *